US005212961A

United States Patent [19]

Graf

[11] Patent Number: 5,212,961

[45] Date of Patent: May 25, 1993

[54] DUAL CYCLE WATER CHILLER

[76] Inventor: William J. Graf, 39-65 52nd St., Woodside, N.Y. 11377

[21] Appl. No.: 775,424

[22] Filed: Oct. 15, 1991

[51] Int. Cl.[5] ..... F25B 15/00

[52] U.S. Cl. ..... 62/333; 62/335

[58] Field of Search ..... 62/333, 335, 476, 434, 62/268

[56] References Cited

U.S. PATENT DOCUMENTS

| | | | |
|---|---|---|---|
| 3,824,804 | 7/1974 | Sandmark | 62/335 X |
| 4,374,468 | 2/1983 | Takeshita et al. | 62/333 |
| 4,471,630 | 9/1984 | Sugimoto et al. | 62/333 X |
| 5,038,574 | 8/1991 | Osborne | 62/335 X |

*Primary Examiner*—John C. Fox

[57] ABSTRACT

A dual cycle water chiller or refrigerating system including both a compression-type (mechanical) refrigerator unit and an absorption-type refrigerator unit; further, having a condenser so configured and arranged as to power the absorption cycle substantially entirely from the heat rejected from the compression cycle. The compression and absorption units share a common hermetic housing. Moreover, the system in accordance with the invention involves a dual circuit evaporator whose elements contain the fluid to be cooled for both the compression and absorption units, these elements being so arranged that the fluid to be cooled is acted upon first by the absorption unit, and then by the compression unit, thus optimizing the operational characteristics of each cycle.

5 Claims, 1 Drawing Sheet

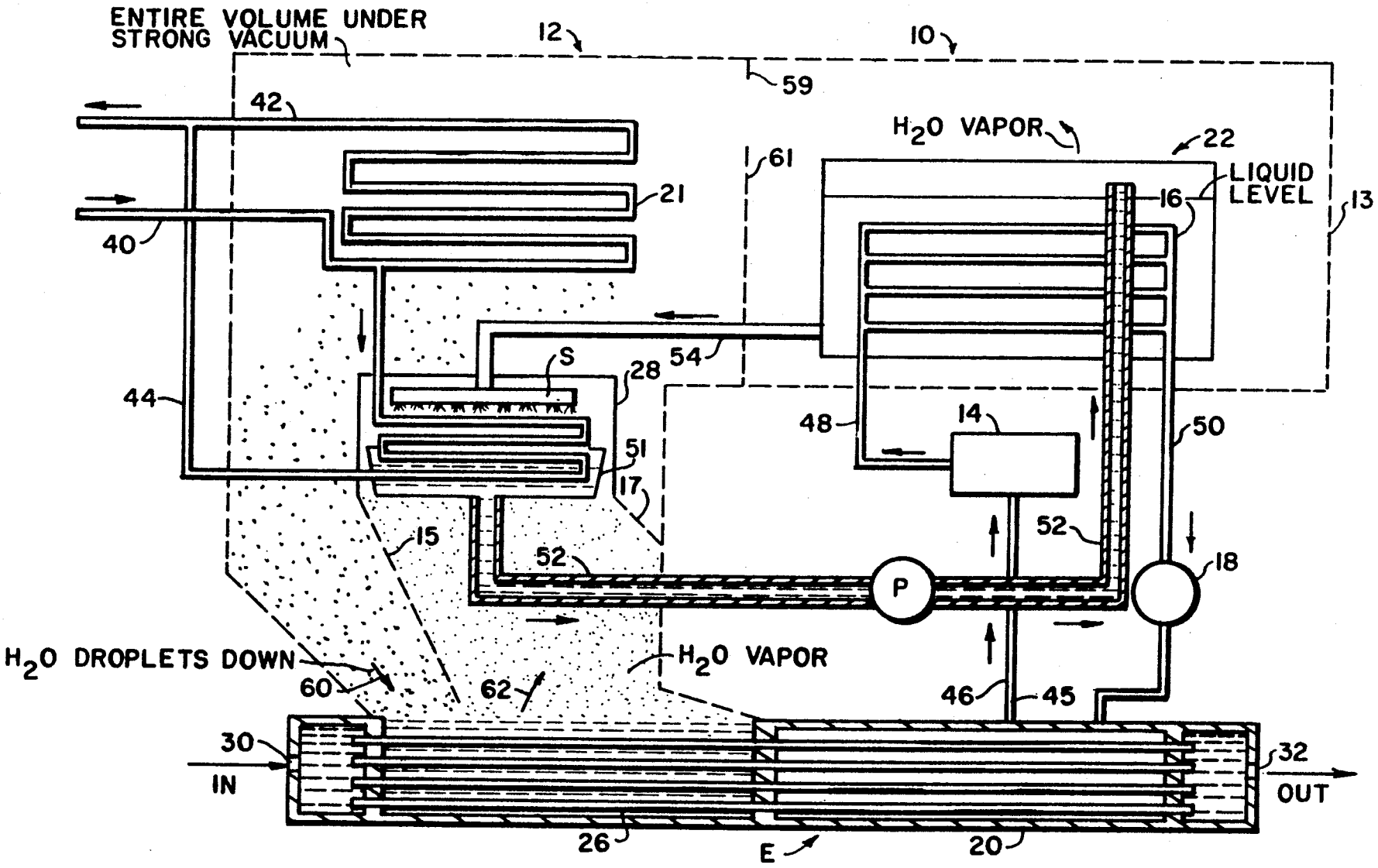
13
LIQUID LEVEL
22
16
50
18
32
OUT
H2O VAPOR
52
45
14
46
20
10
P
48
59
61
E
54
H2O VAPOR
21
28
51
17
26
12
S
52
62
15
ENTIRE VOLUME UNDER STRONG VACUUM
42
60
30
IN
40
44
H2O DROPLETS DOWN

DUAL CYCLE WATER CHILLER

BACKGROUND OF THE INVENTION

The present invention relates to a cooling system, sometimes called a dual cycle water chiller, which includes a compression-type refrigeration unit and an absorption-type refrigeration unit suitable for chilling of fluids and the like.

Cooling systems have been known, as exemplified by U.S. Pat. No. 4,471,630, in which both a compression-type refrigeration unit and an absorption-type unit are arranged in a series system in which the medium to be cooled (such as cold water), having a comparatively high temperature, is cooled down by the evaporator of the absorption-type refrigeration unit and is further cooled by the evaporator of the compression-type refrigeration unit.

An object of the invention disclosed in U.S. Pat. No. 4,471,630 is to provide a cooling system of the aforedescribed combined type in which the combination is arranged so as to attain an efficient use of energy. Whatever the merits of the aforenoted disclosed system and of other similar systems known in the art, such systems have failed to obtain the ultimate possible cost reduction, that is, in a realistic range of 30–40% over more conventional systems.

SUMMARY OF THE INVENTION

Accordingly, it is a primary object of the present invention to realize a fluid chilling or refrigerating system in which the overall thermal efficiency of the system is so substantially increased that cost reductions of the order of 30–40% when compared with conventional systems can be realized.

As is well known, systems in which both compression (or mechanical), and absorption cycles are combined have striven to attain cost reductions of the order noted. However, their fundamental drawback has been that they have not recognized the concept of powering the absorption cycle substantially entirely from the heat rejected from the compression cycle.

Accordingly, it is another fundamental object of the present invention to provide a system in which the absorption cycle is so powered, that is, substantially entirely from the heat rejected from the compression cycle.

This object is attained by a primary feature of the present invention according to which the condenser of the mechanical or compression refrigeration unit is incorporated within the concentrator (or generator) of the absorption unit. In other words, the condenser of the mechanical unit is so configured as to power the absorption cycle substantially entirely from the heat rejected from the compression cycle. This result will be apparent as the description of the invention proceeds.

Another fundamental feature of the present invention resides in the provision of having both processes combined within a hermetic environment sharing substantial heat transfer surface and using common fluid connections.

Other and further objects, advantages and features of the present invention will be understood by reference to the following specification in conjunction with the annexed drawing, wherein like parts have been given like numbers.

BRIEF DESCRIPTION OF THE DRAWING

The figure is a schematic diagram of the system in accordance with one embodiment of the present invention.

DESCRIPTION OF THE PREFERRED EMBODIMENT

Referring now to the schematic diagram of the cooling system seen in the figure, there will be seen a mechanical or compression unit 10, most of whose elements are located on the right of the figure, and an absorption unit 12. However, several elements on the right form part of the absorption unit 12 as will be explained. The compression and absorption units in the refrigeration system share a common housing 13, most of the components of both units being surrounded by such housing. The outer walls of housing 13 are shown by dotted lines, with inner portions 15 and 17 shown by solid lines.

The compression unit comprises a compressor 14, a condenser 16, an expansion device 18, and an evaporator section 20 forming part of a total evaporator E. The absorption refrigeration unit 12 comprises a solution pump P (on the right), a condenser 21, a generating-/concentrating means 22 (also on the right), which together with the condenser 16 forms a combination sometimes called a condensetrator. The absorption unit 12 also comprises an evaporator section 26 (part of evaporator E), an absorber 28, and a strong liquor spray head S.

It will be noted that the fluid to be cooled enters the evaporator E by means of the port 30 and flows first through the absorber unit's evaporator section 26; thence through the compression unit's evaporator section 20, whence it exits the exit port 32. It will be understood that within the evaporator E is the usual fin-like construction for purpose of maximum heat transfer. Likewise it will be understood that condensers 16 and 21, as well as absorber 28 have similar fin-like construction and interiors.

It will be apparent that the cooling medium as it exits from exit port 32 will have been chilled and therefore is at a reduced temperature compared with the intake end.

Referring now to the upper left portion of the figure, a suitable cooling medium from a cooling tower or the like is fed into the system as indicated by line 40. This is the condenser water supply, and, because of the parallel feed, it enters the absorber 28, as well as the condenser 21. After removal of all the heat to be rejected for the entire process, the cooling medium exits the condenser 21 by way of line 42 and from the absorber 28 by way of line 44 at elevated temperatures.

Heat is removed from the fluid flowing through the evaporator section 20 of the compression unit by means of the interior heat transfer surfaces and is transferred into the expanding refrigerant 45 circulating through the unit. The refrigerant used here can be any suitable refrigerant and liquid anhydrous solution, a typical one being lithium bromide.

The low pressure saturated refrigerant gas with increased enthalpy, is drawn by means of suction pipe 46 to the entrance of mechanical compressor 14, the compressor raising the pressure/temperature of the gas. The hot gas in line or pipe 48 then enters the condenser 16 where it gives up its latent heat and condenses to liquid refrigerant. The line 50 returns the liquid refrigerant, through the expansion device 18, to the evaporator section 20, where it again picks up heat from the fluid to be cooled.

As will be understood, heat is removed from the fluid flowing through the absorption unit evaporator, that is, through evaporator section 26, by dint of the heat transfer surfaces thereof, and such heat is transferred into the rapidly evaporating refrigerant (water), thereby producing a low pressure saturated vapor. The vapor is absorbed into the strong liquor being sprayed within the absorber 28 by the spray head S. The heat of absorption is transferred to the cooling water in pipe 40 flowing through the heat transfer surface of absorber 28 and returned by pipe 44 to the cooling tower.

The dilute liquor solution from the absorber 28 is collected by pan 51 and is then circulated by solution pump P by way of pipe 52 into the generator/concentrator 22. The dilute solution is heated (concentrated) and water vapor is removed (generated) at generator/-concentrator 22 by the heat given off by the condensing hot gas as it returns to a liquid in condenser 16.

Because of the strong vacuum on the volume indicated, water vapor from generator/concentrator 22 is pulled through opening 59 in baffle 61. The water vapor is cooled and condensed back to liquid in the condenser 21. The heat of vaporization is transferred into the cooling water, which enters by line 40 and flows through the heat transfer surfaces of condenser 21, and returns by line 42. Liquid water refrigerant is then returned to evaporator section 26, shown by arrow 60, where it can again boil off as a low pressure vapor, shown by arrow 62, removing more heat from the fluid to be cooled. The strong liquor (concentrated absorbant) from the generator/concentrator 22 is returned by way of pipe 54 to the absorber spray header S to again be diluted by absorbing the refrigerant water vapor.

What has been disclosed in accordance with the present invention is a cooling system involving compression and absorption units with both processes or cycles combined within a hermetic environment sharing substantial heat transfer surfaces and using common fluid connections. By having the compression system and compression unit condenser arranged within the generator/concentrator component, the condenser in effect becomes the generator/concentrator of the absorption system and the condenser section of the system rejects the heat and applies it to run the absorption unit.

The head pressure and corresponding condensing temperatures of the mechanical refrigeration unit or side of the system can be varied to suit the needs of the absorption cycle and the absorption process can be optimized as well to suit the heat input available from the mechanical refrigeration side.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A cooling system comprising the combination of a compression unit and an absorption unit;

said compression unit having a compressor, a first condenser means, and an expansion device;

said absorption unit having a solution pump, a second condenser means, a generating/concentrating means; an absorber, and a strong liquor spray head within said absorber;

a single evaporator having first and second sections, said first section forming part of said compression unit and said second section forming part of said absorber unit;

means within said evaporator for permitting the fluid being cooled to flow serially and continuously through said evaporator sections so as to enable both the compression unit and the absorber unit to operate immediately and directly on said fluid.

2. A cooling system as defined in claim 1, in which said evaporator is integrally formed with said two independent evaporator sections such that first and second refrigerants separately contact the respective sections, said evaporator having a single input port and a single output port for said fluid being cooled.

3. A cooling system as defined in claim 2, further comprising means, including said compressor, for circulating the first refrigerant from said first evaporator section to said first condensing means, and means for circulating said second refrigerant from said second evaporator to said absorber.

4. The cooling system as defined in claim 3, further comprising means for transmitting cooling fluid from a cooling tower into the second condenser means of the absorption unit and into the absorber of said absorption unit.

5. The cooling system as defined in claim 1, wherein said solution pump is operative for circulating liquor from said absorber to said generating/concentrating means.

* * * * *